US008096086B2

(12) United States Patent
Fletcher

(10) Patent No.: US 8,096,086 B2
(45) Date of Patent: Jan. 17, 2012

(54) CAST-IN LIFTING ANCHOR

(75) Inventor: Geoffrey Alan Fletcher, Victoria (AU)

(73) Assignee: ITW Construction Systems Australia Pty Ltd, Victoria (AU)

( * ) Notice: Subject to any disclaimer, the term of this patent is extended or adjusted under 35 U.S.C. 154(b) by 221 days.

(21) Appl. No.: 12/305,393

(22) PCT Filed: Jun. 27, 2007

(86) PCT No.: PCT/IB2007/001767

§ 371 (c)(1),
(2), (4) Date: Dec. 8, 2008

(87) PCT Pub. No.: WO2008/001206

PCT Pub. Date: Jan. 3, 2008

(65) Prior Publication Data

US 2009/0205268 A1 Aug. 20, 2009

(30) Foreign Application Priority Data

Jun. 28, 2006 (AU) ..... 2006903469
Sep. 8, 2006 (AU) ..... 2006904993
May 24, 2007 (AU) ..... 2007202357

(51) Int. Cl.
*E04G 21/14* (2006.01)
*E04H 13/00* (2006.01)
*E04B 1/38* (2006.01)

(52) U.S. Cl. ..... 52/125.4; 52/124.2; 52/698; 52/707

(58) Field of Classification Search ..... 52/122.1, 52/124.2, 125.1–125.5, 712, 715, 127.2, 52/698, 701, 704, 707; D25/133, 134
See application file for complete search history.

(56) References Cited

U.S. PATENT DOCUMENTS 308,837 A * 12/1884 Frost ..... 411/448
982,210 A * 1/1911 Johnson ..... 52/378
1,280,173 A * 10/1918 Cutler ..... 52/712
4,096,677 A * 6/1978 Gilb ..... 52/297
D272,517 S * 2/1984 Koehn ..... D8/349
4,603,522 A * 8/1986 Johnson ..... 52/125.4
4,624,089 A * 11/1986 Dunker ..... 52/410
4,627,198 A 12/1986 Francies, III
4,995,206 A * 2/1991 Colonias et al. ..... 522/97

(Continued)

FOREIGN PATENT DOCUMENTS

AU 200027607 B2 10/2000

(Continued)

OTHER PUBLICATIONS

ISR for PCT/IB2007/001767 dated Nov. 16, 2007.

*Primary Examiner* — Robert Canfield
*Assistant Examiner* — Charissa Ahmad
(74) *Attorney, Agent, or Firm* — Lowe Hauptman Ham & Berner LLP

(57) ABSTRACT

An edge-lift anchor for tilt-up lifting of a concrete component has, at a lower part of its head an element for anchoring the head against shear forces acting during the tilt-up phase of lifting. Such element comprises an aperture to receive concrete, an aperture to receive a reinforcing bar, or a shear plate welded to the lower edge of the head.

21 Claims, 4 Drawing Sheets

U.S. PATENT DOCUMENTS

| | | | | | |
|---|---|---|---|---|---|
| 5,596,846 | A | | 1/1997 | Kelly | |
| D389,251 | S | * | 1/1998 | Kelly | D25/133 |
| 5,857,296 | A | * | 1/1999 | Niday et al. | 52/125.1 |
| 5,987,830 | A | * | 11/1999 | Worley | 52/309.11 |
| D429,628 | S | * | 8/2000 | Peters | D8/390 |
| 6,126,372 | A | * | 10/2000 | Takata | 411/513 |
| 6,550,834 | B2 | * | 4/2003 | Fromelius | 294/89 |
| 6,640,516 | B1 | * | 11/2003 | Thompson | 52/712 |
| D486,250 | S | * | 2/2004 | Mettler et al. | D25/133 |
| D520,649 | S | * | 5/2006 | Hansort | D25/133 |
| D521,159 | S | * | 5/2006 | Hansort | D25/133 |
| 7,111,432 | B2 | | 9/2006 | Hansort | |
| 7,356,972 | B2 | * | 4/2008 | Leek et al. | 52/650.3 |
| 7,448,178 | B2 | * | 11/2008 | Visone | 52/712 |
| 2004/0010985 | A1 | * | 1/2004 | Francies et al. | 52/125.4 |
| 2004/0159070 | A1 | * | 8/2004 | Hansort | 52/698 |
| 2005/0086897 | A1 | * | 4/2005 | Roesset et al. | 52/698 |
| 2006/0248813 | A1 | * | 11/2006 | Fletcher et al. | 52/125.4 |

FOREIGN PATENT DOCUMENTS

| | | | |
|---|---|---|---|
| WO | 9010763 | A1 | 9/1990 |
| WO | 2004074584 | A2 | 9/2004 |
| WO | 2005077129 | A2 | 8/2005 |

* cited by examiner

PRIOR ART

PRIOR ART

CAST-IN LIFTING ANCHOR

RELATED APPLICATIONS

The present application is based on International Application Number PCT/IB07/01767 filed Jun. 27, 2007, and claims priority from Australian Application Number 2007202357 filed May 24, 2007, Australian Application Number 2006904993 filed Sep. 8, 2006 and Australian Application Number 2006903469, filed Jun. 28, 2006, the disclosures of which are hereby incorporated by reference herein in their entirety.

TECHNICAL FIELD

The present invention relates to a cast-in lifting anchor intended to be incorporated into a concrete component prior to casting to provide a lifting point by which the component can be lifted. More particularly the invention relates to an edge-lift anchor.

BACKGROUND

Concrete lifting systems for lifting of concrete panels and other components typically involve the use of lifting anchors incorporated into the component during casting, with the head of the anchor being encased within a removable or disposable hollow void former to form within the surface of the component a recess within which the head of the anchor lies for releasable coupling to lifting equipment. In one commonly used construction technique concrete panels are cast on site on a concrete slab or other flat surface. To erect the panel it is lifted from a horizontal configuration which it is cast to a vertical configuration by tilting the panel about its lower edge and when in its vertical configuration it is then moved to the required position for installation while still suspended from the lifting equipment. The general construction method in which the panel is cast on site and then is initially lifted from the horizontal to the vertical in the manner described is commonly known as tilt-up construction. In tilt-up construction the panel can be lifted either using anchors in which their lifting heads are exposed to the upper face of the panel (this is known as face-lift) or to the upper edge of the panel (this is known as edge-lift). Face-lift and edge-lift anchors are of different construction and the choice between a face-lift and an edge-lift situation is determined by engineering considerations and structural considerations.

Concrete panels may also be pre-cast in a similar manner in a factory or other off-site facility. In that case the panel will usually incorporate edge-lift anchors by which, after casting, it is raised by the same type of tilt-up action to an upright configuration for storage and/or transportation to site at which it will be lifted from the truck by means of its edge-lift anchors while in its upright condition and then moved to the required position for installation while still suspended from the lifting equipment.

Accordingly, as used herein the term "tilt-up" is intended to include not only construction situations in which a concrete panel or other component is cast on-site and then raised by tilting to an upright configuration for installation but also the manufacture of pre-cast concrete panels and other components off-site in which the component after casting is raised by tilting to an upright configuration for storage and/or transportation to site for subsequent installation.

FIG. 1 shows diagrammatically an edge-lift anchor 1 in its installed position for tilt-up lifting. The anchor has a head 2 for coupling to lifting apparatus and an anchoring portion in the form of a pair of substantially parallel legs 4 extending from the head. The particular head 2 shown is designed for co-operation with a lifting clutch in the form of a ring clutch with an arcuate locking bolt received within the eye 6 of the head, although it is to be understood that the head could be of a different detailed design for use with other types of lifting apparatus. The legs 4 are profiled so as to lock into the surrounding concrete. The particular profiling shown forms the subject of patent application 2006201337 (the contents of which are hereby incorporated by reference) but it is to be understood that the legs 4 may have any other form of profile to lock into the surrounding concrete and the anchoring portion may even be of a form which does not use two parallel legs. At the commencement of tilt-up lifting, the anchor is subjected to a substantial shear force acting in the direction of the arrows shown in FIG. 2. In this configuration, the upper edge of the anchor lies quite close to the upper face of the panel and there is insufficient depth of embedment to resist the shear force. The current practice to resist that shear force so as to prevent the anchor from breaking through onto the upper face of the panel is to provide a shear bar 8 which passes across a recess in the upper edge of the anchor and is bent downwardly at each side of the anchor to form horizontal portions 8*a* embedded more deeply within the thickness of the panel and possibly associated with further reinforcing bars 10 as shown in FIG. 3.

SUMMARY

According to the present invention there is provided an edge-lift anchor for embedment into a concrete component for tilt-up lifting, the anchor having a head for releasable engagement with lifting equipment, and an anchoring portion extending from the head to lock the anchor into the surrounding concrete, the head having within a lower part, as considered in relation to the installed condition of the anchor, an aperture to receive concrete which anchors the head against shear forces acting on the head during the tilt-up phase of lifting.

As a result of this construction of anchor, there is no need to install a conventional shear bar to resist the shear force.

In a preferred embodiment of the invention, the anchoring portion comprises parallel legs profiled to lock into the surrounding concrete.

Advantageously the lower edge of the aperture is substantially straight and extends substantially parallel to the longitudinal axis of the anchor. It is preferred to shape the head so that its lower edge is formed with a downwards extension which contains at least a lower part of the aperture so as to maximise the depth of embedment of its lower edge which constitutes the primary bearing surface for shear resistance. When, as is preferred, a row of such anchors in side-by-side relation is cut from thick metal plate by high energy non-contact cutting, this extension of the lower edge of the head of one anchor will result in a recess of complementary shape formed in the upper edge of the head of an adjacent anchor and that recess has utility in accommodating one or more perimeter bars which may be incorporated as part of the reinforcement of the concrete component.

In order to increase the shear resistance, a shear plate may be welded to the lower edge of the head and preferably to the lower edge of its downwards extension.

In a modification the transverse shear plate discussed above may act without the need to incorporate the aperture for shear resistance.

Accordingly a further aspect of the invention provides an edge-lift anchor for embedment into a concrete component for tilt-up lifting, the anchor having a head for releasable engagement with lifting equipment, and an anchoring portion extending from the head to lock the anchor into the surrounding concrete, the head having at a lower edge, as considered in relation to the installed condition of the anchor, a plate extending transversely to the head to anchor the head against shear forces acting on the head during the tilt-up phase of lifting.

The present invention also provides a cast concrete panel having installed therein one or more edge-lift anchors as defined above, wherein the panel is cast for tilt-up lifting and the or each edge-lift anchor is locked into the concrete by the presence of the aperture and/or plate to provide shear resistance during the tilt-up phase of lifting without the need for the necessary presence of a shear bar.

Although the anchors defined above provide shear resistance without needing a shear bar, an alternative version of the anchor uses a shear bar but only at the lower part of the anchor, thereby maintaining the upper part of the anchor unobstructed.

Therefore, according to yet a further aspect of the invention, there is provided an edge-lift anchor for embedment into a concrete component for tilt-up lifting, the anchor having a head for releaseable engagement with lifting equipment, and an anchoring portion extending from the head to lock the anchor into the surrounding concrete, the head having at a lower part, as considered in relation to the installed condition of the anchor, an aperture through which extends a length of bar transversely to the head to anchor the head against shear forces acting on the head during the tilt-up phase of lifting.

According to another aspect of the invention, there is provided an edge-lift anchor for embedment into a concrete component for tilt-up lifting, the anchor having a head for releasable engagement with lifting equipment, and an anchoring portion extending from the head to lock the anchor into the surrounding concrete, the head having at an upper edge, as considered in relation to the installed condition of the anchor, a recess for accommodating one or more perimeter bars which may be incorporated as part of the reinforcement for the concrete component.

BRIEF DESCRIPTION OF THE DRAWINGS

An embodiment of the invention will now be described by way of example only with reference to the accompanying drawings in which.

DETAILED DESCRIPTION

Figure 4:
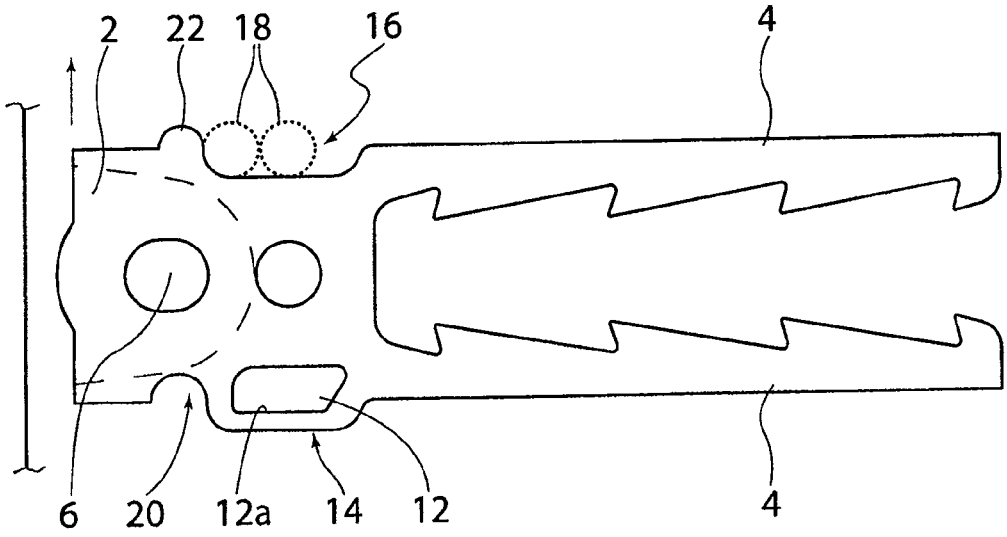
FIG. 4 is a side view of an anchor in accordance with the preferred embodiment of the invention which is configured to provide shear resistance without the need to provide a shear bar.

FIG. 4 shows an edge-lift anchor in accordance with a preferred embodiment of the invention. Preferably, the anchor is cut from thick metal plate preferably by laser beam or plasma arc cutting. Although the anchor is of the same type as that shown in FIG. 1 it is to be understood that the invention is not confined to edge-lift anchors having an anchoring portion formed by parallel legs or a head portion of the specific form shown which is designed for use with a releasable lifting clutch in the form of a ring clutch.

Figure 1:
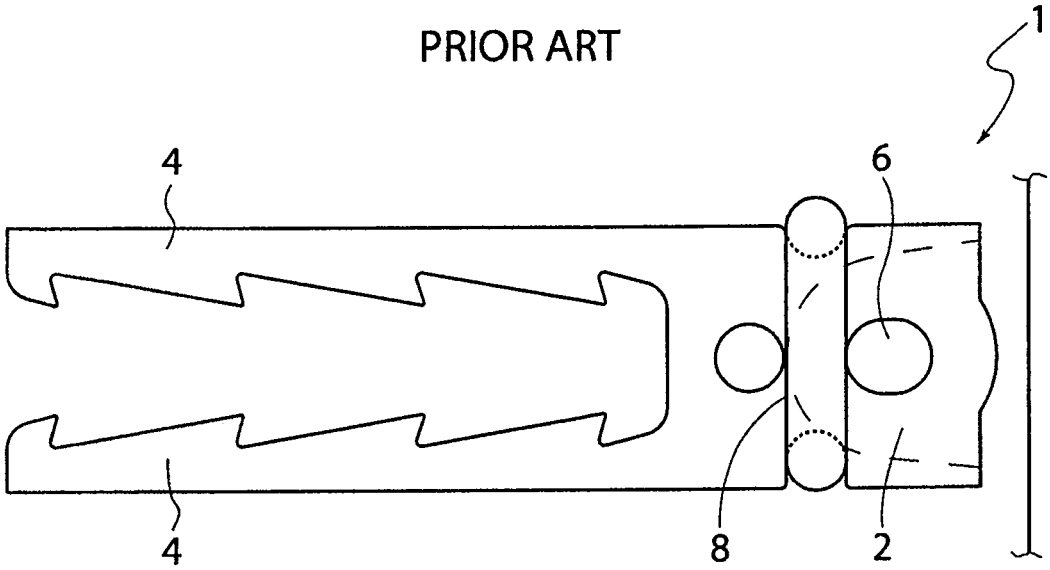
FIG. 1 PRIOR ART
FIGS. 1-3 show a conventional device.
Figure 3:
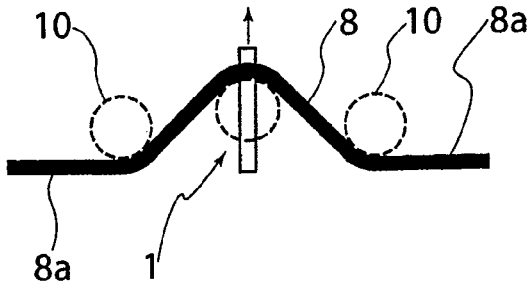

In accordance with the invention, the lower portion of the head 2 as considered in relation to the installed position of the anchor prior to lifting, includes an aperture 12. The lower edge 12*a* of the aperture 12 extends substantially parallel to the axis of the anchor and provides a bearing surface with the concrete which fills that aperture to provide the necessary shear resistance needed in the tilt-up phase of a lifting operation without the need to incorporate a conventional shear bar 8 as shown in FIGS. 1 and 3. Although the overall profile of the aperture 12 is not critical, the depth and width of the aperture 12 should be as large as possible to maximise the volume of concrete captured within the aperture and its lower edge 12*a* which provides the bearing surface should be substantially planar and as long as possible. As the shear resistance is related to the depth of embedment of the aperture 12, and specifically its lower bearing surface 12*a*, from the upper face of the concrete panel, the lower edge of the head is shaped with a downwards extension 14 to permit the aperture 12 to be placed lower in the head that would otherwise be possible, thereby increasing the shear resistance.

The provision of the extension 14 to accommodate the aperture 12 also provides another effect. The anchor is cut from thick metal plate preferably by laser beam, plasma arc, or other high energy non-contact cutter. For economy of cutting and material, a row of several anchors will be cut in side-by-side relation across the plate whereby the extended lower zone in the head of one anchor will result in a recess of complementary shape being formed in the upper edge of the adjacent anchor. This recess is shown at 16 in FIG. 4. The recess 16 is able to accommodate one or more perimeter bars 18 which form part of the reinforcement for the panel itself and which are basically unrelated to the loading applied to the lifting anchor during erection. The recess 16 is of a length to accommodate some variation in the positioning of the perimeter bar(s) and as shown is such as to be able to accommodate two perimeter bars with variation in their positioning. Accordingly this does somewhat ease the installation of the perimeter bar(s) relative to the anchor. This feature is of benefit even absent the described provision for built-in shear resistance. In the embodiment shown, the lower edge of the head includes a recess 20 for a lower perimeter bar outwardly of the shear resistance aperture 12 and the presence of this recess is mirrored by the provision of a corresponding extension 22 formed at the upper edge of the head during cutting of adjacent anchors from the metal plate.

Figure 5:
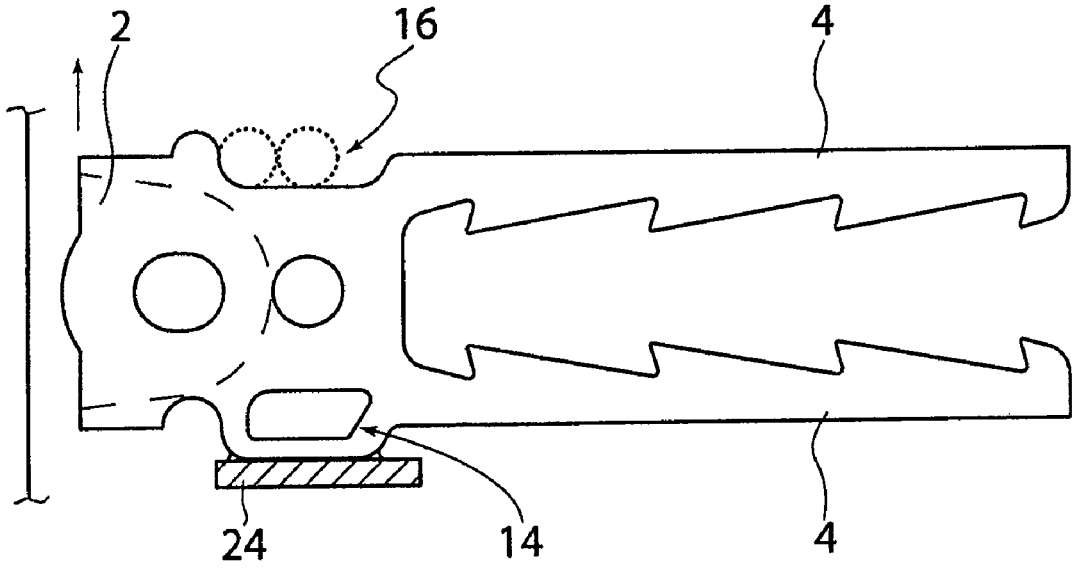
FIG. 5 is a side view of a modified form of the anchor shown in FIG. 4.
Figure 6:
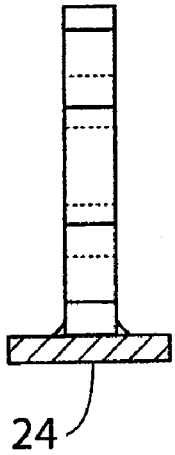
FIG. 6 is an end view of the anchor shown in FIG. 5.

FIGS. 5 and 6 show a variation in which a plate 24 is welded to the underside of the extension 14 to project transversely to the plane of the anchor and thereby further increase the resistance to shear loading during the tilt-up phase of lifting. Depending on engineering considerations, the presence of this plate may be needed in some situations subject to higher shear loading. In a further variation (not shown) the shear plate may be provided absent the presence of the aperture 14 whereby it is the shear plate alone which provides the necessary shear resistance for the anchor. In that case although the head need not be provided with the downwards extension 14, nevertheless it is preferred that the extension is present as that will result in a corresponding increase in the depth of embedment of the shear plate and will also result in the presence of the corresponding recess 16 in the upper edge of the anchor during cutting from thick metal plate.

Figure 2:
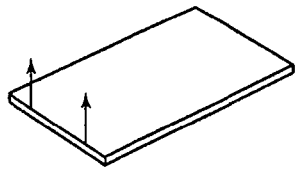
Figure 7:
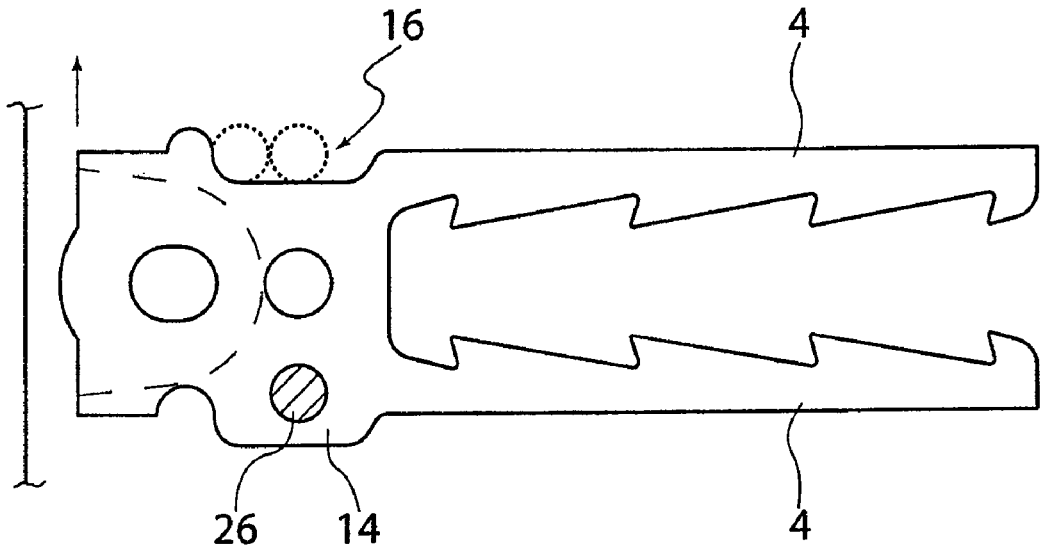
FIG. 7 is a side view of a further modified form of the anchor shown in FIG. 4.
Figure 8:
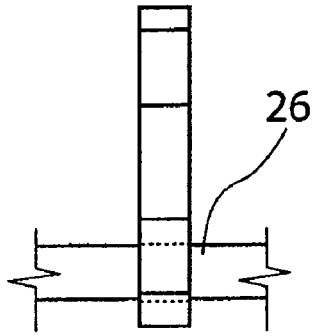
FIG. 8 is an end view of the anchor shown in FIG. 7.

FIGS. 7 and 8 show a further variation in which the extension 14 is formed with a punched circular aperture of a size to receive a length of reinforcing bar 26 which acts as a shear bar to provide resistance to shear loading during the tilt-up phase of lifting. It is to be noted that this differs from a conventional arrangement as described with reference to FIGS. 1 to 3 in that the shear bar is simply a straight length of bar which can be installed simply by the user and acts at the lower edge portion of the anchor (as shown, in the downwards extension 14) whereby the upper edge of the anchor is left free for cooperation with other reinforcements, such as the perimeter bars 18.

The embodiments have been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. An edge-lift anchor for embedment into a concrete component for tilt-up lifting, the anchor comprising:

a head for releasable engagement with lifting equipment, and an anchoring portion comprising a leg extending from the head in a longitudinal direction of the anchor to lock the anchor into the surrounding concrete, the head having opposite upper and lower parts adapted to be arranged in that order when the anchor is installed in the concrete component before lifting, the head further having, within the lower part, an aperture to receive concrete which anchors the head against shear forces acting on the head during a tilt-up phase of lifting, the lower part of the head having a downward extension, and the upper part of the head having a recess for accommodating one or more perimeter bars for reinforcement of the concrete component, wherein the recess is of the same size and shape as said downward extension;

wherein said anchor further comprises, in order to increase shear resistance of the anchor, a shear plate welded to the lower part of the head.

2. An anchor according to claim 1, wherein the anchoring portion comprises parallel legs profiled to lock into the surrounding concrete.

3. An anchor according to claim 1, wherein a lower edge of the aperture is substantially straight and extends substantially parallel to the longitudinal direction of the anchor.

4. An anchor according to claim 1, wherein the downwards extension contains at least a lower part of the aperture.

5. An anchor according to claim 1, wherein the upper part of the head of the anchor further has an upward extension, and the lower part of the head has a further recess for accommodating a further perimeter bar for reinforcement of the concrete component, and the further recess is of the same size and shape as said upward extension.

6. An edge-lift anchor for embedment into a concrete component for tilt-up lifting, the anchor comprising:

a head for releasable engagement with lifting equipment, and an anchoring portion comprising a leg extending from the head in a longitudinal direction of the anchor to lock the anchor into the surrounding concrete, the head having opposite upper and lower parts adapted to be arranged in that order when the anchor is installed in the concrete component before lifting, the head further having, within the lower part, an aperture to receive concrete which anchors the head against shear forces acting on the head during a tilt-up phase of lifting, the lower part of the head having a downward extension, and the upper part of the head having a recess for accommodating one or more perimeter bars for reinforcement of the concrete component, wherein the recess is of the same size and shape as said downward extension;

wherein said anchor further comprises, in order to increase shear resistance of the anchor, a shear plate welded to a lower edge of the downwards extension.

7. An edge-lift anchor for embedment into a concrete component for tilt-up lifting, the anchor comprising:

a head for releasable engagement with lifting equipment, and an anchoring portion extending from the head in a longitudinal direction of the anchor to lock the anchor into the surrounding concrete, the head having opposite upper and lower parts adapted to be arranged in that order when the anchor is installed in the concrete component before lifting, the head further having, at a lower edge of the lower part, a shear plate extending transversely to the head to anchor the head against shear forces acting on the head during a tilt-up phase of lifting, the lower part of the head having a downward extension, and the upper part of the head having a recess for accommodating one or more perimeter bars for reinforcement of the concrete component, wherein the recess is of the same size and shape as said downward extension.

8. An anchor according to claim 7, wherein the anchoring portion comprises parallel legs profiled to lock into the surrounding concrete.

9. An anchor according to claim 7, wherein the shear plate is welded to the lower edge of the downward extension.

10. An anchor according to claim 7, wherein the recess and the downward extension are all elongated in the longitudinal direction of the anchor.

11. An anchor according to claim 9, wherein the upper part of the head of the anchor further has an upward extension, and the lower part of the head has a further recess for accommodating a further perimeter bar for reinforcement of the concrete component, and the further recess is of the same size and shape as said upward extension.

12. In combination, an edge-lift anchor embedded into a concrete component for tilt-up lifting, the anchor comprising:

a head for releasable engagement with lifting equipment, and an anchoring portion extending from the head in a longitudinal direction of the anchor to lock the anchor into the surrounding concrete, the head having opposite upper and lower parts adapted to be arranged in that order when the anchor is installed in the concrete component before lifting, the lower part of the head having a downward extension, and the upper part of the head having a recess accommodating one or more perimeter bars for reinforcement for the concrete component, wherein the recess is of the same size and shape as said downward extension.

13. A combination according to claim 12, wherein the head further has, at the lower part, an aperture receiving therethrough a length of bar which extends transversely to the anchor to anchor the head against shear forces acting on the head during a tilt-up phase of lifting.

14. A combination according to claim 13, wherein the anchoring portion comprises parallel legs profiled to lock into the surrounding concrete.

15. A combination according to claim 13, wherein the downwards extension contains at least a lower part of the aperture.

16. A combination according to claim 15, wherein the upper part of the head of the anchor further has an upward extension, and the lower part of the head has a further recess for accommodating a further perimeter bar for reinforcement of the concrete component, and the further recess is of the same size and shape as said upward extension.

17. A combination according to claim 13, wherein the recess and the downward extension are all elongated in the longitudinal direction of the anchor.

18. A combination according to claim 12, wherein a length of the recess is sufficient to accommodate two or more such perimeter bars arranged side by side.

19. A combination according to claim 18, wherein the length of the recess is sufficient to accommodate a degree of variation in the positioning of the perimeter bars within the recess.

20. A combination according to claim 12, wherein the anchoring portion comprises parallel legs profiled to lock into the surrounding concrete.

21. A combination according to claim 12, wherein the upper part of the head of the anchor further has an upward extension, and the lower part of the head has a further recess for accommodating a further perimeter bar for reinforcement of the concrete component, and the further recess is of the same size and shape as said upward extension.

* * * * *